US009761084B2

(12) United States Patent
Alexander

(10) Patent No.: US 9,761,084 B2
(45) Date of Patent: Sep. 12, 2017

(54) PICK THE BOARD

(71) Applicant: KIZZANG LLC, Las Vegas, NV (US)

(72) Inventor: Robert Alexander, Las Vegas, NV (US)

(73) Assignee: KIZZANG, LLC, Las Vegas, NV (US)

( * ) Notice: Subject to any disclaimer, the term of this patent is extended or adjusted under 35 U.S.C. 154(b) by 0 days.

(21) Appl. No.: 14/520,553

(22) Filed: Oct. 22, 2014

(65) Prior Publication Data

US 2016/0117881 A1 Apr. 28, 2016

(51) Int. Cl.
*A63F 9/24* (2006.01)
*G07F 17/32* (2006.01)

(52) U.S. Cl.
CPC ..... *G07F 17/3244* (2013.01); *G07F 17/326* (2013.01); *G07F 17/3288* (2013.01)

(58) Field of Classification Search
None
See application file for complete search history.

(56) References Cited

U.S. PATENT DOCUMENTS

2003/0060257 A1* 3/2003 Katz ..... A63F 3/00157 463/16
2003/0092477 A1* 5/2003 Luciano, Jr. ..... B26F 3/002 463/16
2005/0064925 A1* 3/2005 Robb ..... G07F 17/32 463/16
2006/0035697 A1* 2/2006 Packes ..... G07F 17/32 463/17
2006/0224456 A1* 10/2006 Walker ..... G06Q 30/02 705/14.1
2007/0135199 A1* 6/2007 Chen ..... G07F 17/32 463/16
2009/0098923 A1* 4/2009 Randhawa ..... G06Q 20/045 463/17
2009/0247259 A1* 10/2009 Napolitano ..... G07F 17/3244 463/18
2009/0280886 A1* 11/2009 Randhawa ..... G07F 17/32 463/17

* cited by examiner

*Primary Examiner* — Paul A D'Agostino
(74) *Attorney, Agent, or Firm* — Ascenda Law Group, PC

(57) ABSTRACT

A "Pick the Board" game allows players to compete for cash prizes by selecting (either manually or automatically through a "quick pick") the winners of an entire week's (or other time period's) worth of designated sporting events, such as football games, basketball games, baseball games, etc. Importantly, participants are not charged any entry fee for participating in the game and winners receive cash prizes.

1 Claim, 5 Drawing Sheets

86

| MATCHUP | DATE / TIME | YOUR PICK | WINNER | SCORE |
|---|---|---|---|---|
| A vs B | Game 1 Date / Time | TEAM A | | |
| C vs D | Game 2 Date / Time | TEAM D | TEAM D | VIEW |
| E vs F | Game 3 Date / Time | TEAM F | | |
| . . . | . . . | . . . | . . . | . . . |
| Y vs Z | Game N Date / Time | TEAM Y | | |

FIGURE 6

PICK THE BOARD

FIELD OF THE INVENTION

The present invention relates to on-line gaming, and more specifically to methods and systems for conducting an on-line game that permits players to "pick the board".

BACKGROUND

On-line gaming is a popular pastime and many different games are available. Likewise, gambling is a popular pastime and on-line gambling sites attract many users. In many jurisdictions, however, on-line gambling is illegal. The present invention, however, provides a legal sweepstakes, free of charge, that allows users (participants) to experience the excitement of on-line gaming without the drawbacks of actual gambling.

BRIEF DESCRIPTION OF THE DRAWINGS

FIG. 6 illustrates an example of a summary screen that includes a player's picks as submitted using a game piece configured in accordance with embodiments of the present invention.

DESCRIPTION

Figure 1:
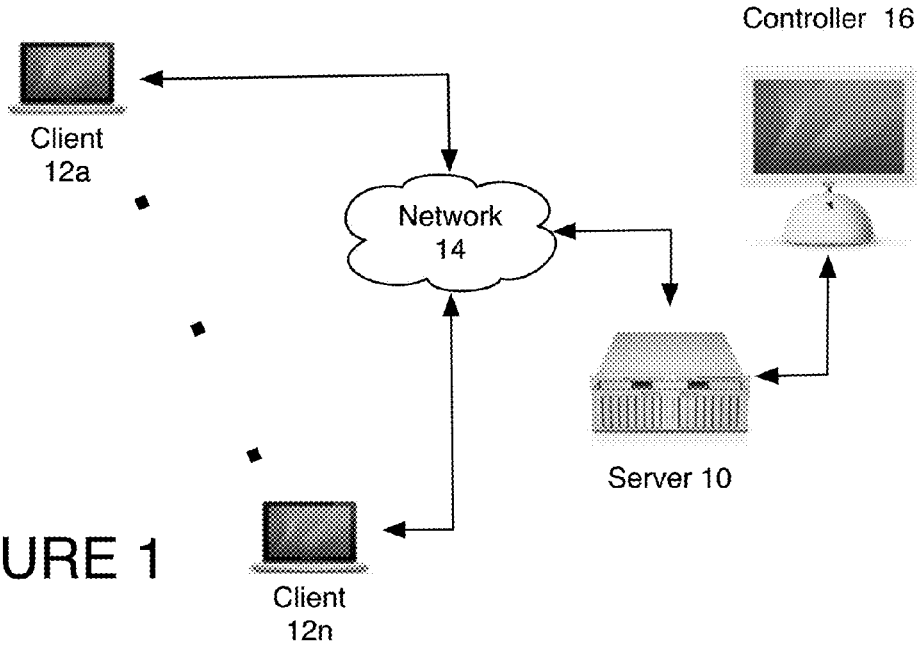
FIG. 1 illustrates an example of a computer network environment within which embodiments of the present invention may be instantiated.

The present "Pick the Board" game allows players to participate in an on-line game that requires players to compete for cash prizes by selecting (either manually or automatically through a "quick pick") the winners of an entire week's (or other time period's) worth of designated sporting events, such as football games, basketball games, baseball games, etc. Importantly, participants are not charged any entry fee for participating in the game and winners receive cash prizes.

As shown in the accompanying Figures, players participate by selecting the winners of the designated games. Selections may be made by activating sliders, checking boxes or radio buttons, or any other means of designating a predicted winner in the subject sporting event. Winners for all events comprising the week's schedule must be selected to be eligible for the prize money. The tournament (or Promotion) has rules. In one embodiment:

A. The Promotion gives participants the opportunity to use their skill and knowledge of professional football to predict the winners of the regularly scheduled games each week (each, a "Week" and collectively, the "Weeks") of the professional football regular season (the "Picks").

B. If any participant correctly picks all of the winners in all of the games played in any given Week, such participant will win that Week's prize, subject to verification of eligibility.

C. In the event more than one (1) participant correctly picks all of the winners in all of the games played in any given Week, the available prize for that Week will be split evenly amongst all participants correctly picking the winners in all of the games in that Week.

D. In no event will any participant receive more than one (1) prize in any given Week during a Promotion period (the time during which the Promotion is offered) regardless of how many correct Picks are submitted in that Week.

E. If no participant correctly picks all of the winners in all of the games played in any given Week, no prize will be awarded.

F. To participate, during the Promotion period visit a website (the "Website"), log-in to a member account, locate a link for the Promotion, and follow the online instructions to complete Picks.

G. All Picks for a given week must be submitted prior to the start of that Week's games and in accordance with the example set forth in the chart below.

F. Players may not submit duplicate Picks in any given Week.

G. Players may submit Picks for any Week of the Promotion Period at any time during the Promotion Period prior to the close of the corresponding Week. For example, Picks may be submitted according to a schedule such as that illustrated in Table 1.

TABLE 1

Schedule for Submission of Picks by Week

| Week # | Week Starts (at 9:00 p.m. PT) | Picks Submitted By | # of Games | Prize | Odds of Winning |
|---|---|---|---|---|---|
| 8 | Oct. 21, 2013 | Oct. 24, 2013 at 5:24 p.m. PT | 13 | $3,000 | 1:8,192 |
| 9 | Oct. 28, 2013 | Oct. 31, 2013 at 5:24 p.m. PT | 13 | $3,000 | 1:8,192 |
| 10 | Nov. 4, 2013 | Nov. 7, 2013 at 5:24 p.m. PT | 14 | $4,000 | 1:16,384 |
| 11 | Nov. 11, 2013 | Nov. 14, 2013 at 5:24 p.m. PT | 15 | $5,000 | 1:32,768 |
| 12 | Nov. 18, 2013 | Nov. 21, 2013 at 5:24 p.m. PT | 14 | $4,000 | 1:16,384 |
| 13 | Nov. 25, 2013 | Nov. 28, 2013 at 9:29 a.m. PT | 16 | $10,000 | 1:65,536 |
| 14 | Dec. 2, 2013 | Dec. 5, 2013 at 5:24 p.m. PT | 16 | $10,000 | 1:65,536 |
| 15 | Dec. 9, 2013 | Dec. 12, 2013 at 5:24 p.m. PT | 16 | $10,000 | 1:65,536 |
| 16 | Dec. 16, 2013 | Dec. 22, 2013 at 9:59 a.m. PT | 16 | $10,000 | 1:65,536 |
| 17 | Dec. 23, 2013 | Dec. 29, 2013 at 9:59 a.m. PT | 16 | $10,000 | 1:65,536 |

H. Once Picks are submitted, they cannot be changed.

I. Each Pick for a given week counts as one (1) game or tournament towards each Member's daily play allotment.

J. Players are preferably registered and logged in at the Website in order to participate in the Promotion.

K. Participation may be through the Website or through a mobile app (if available).

Referring to FIG. 1, a server 10 is configured to communicate with one or more client computers 12*a*-12*n* via network 14 (e.g., the Internet) to provide players (participants) associated with the client computers access to a tournament hosted on server 10. Of course, to facilitate access by hundreds or even thousands of client computers, server 10 may be a server farm with appropriate load balancers so as to provide each player with a satisfactory gaming experience that involves minimal latency. Instances of server 10 are configured by a tournament organizer, for example via controller 16, to provide the same game to all players who participate in the tournament. Notification of the tournament, the tournament rules, playing conditions, etc., may be provided to individual players upon such players logging in to a respective account, through which the players may access the tournament if and when they choose to do so. For a player engaged in the tournament, his or her playing time will commence at a date and time of his or her own choosing within the defined tournament play period.

Figure 2:
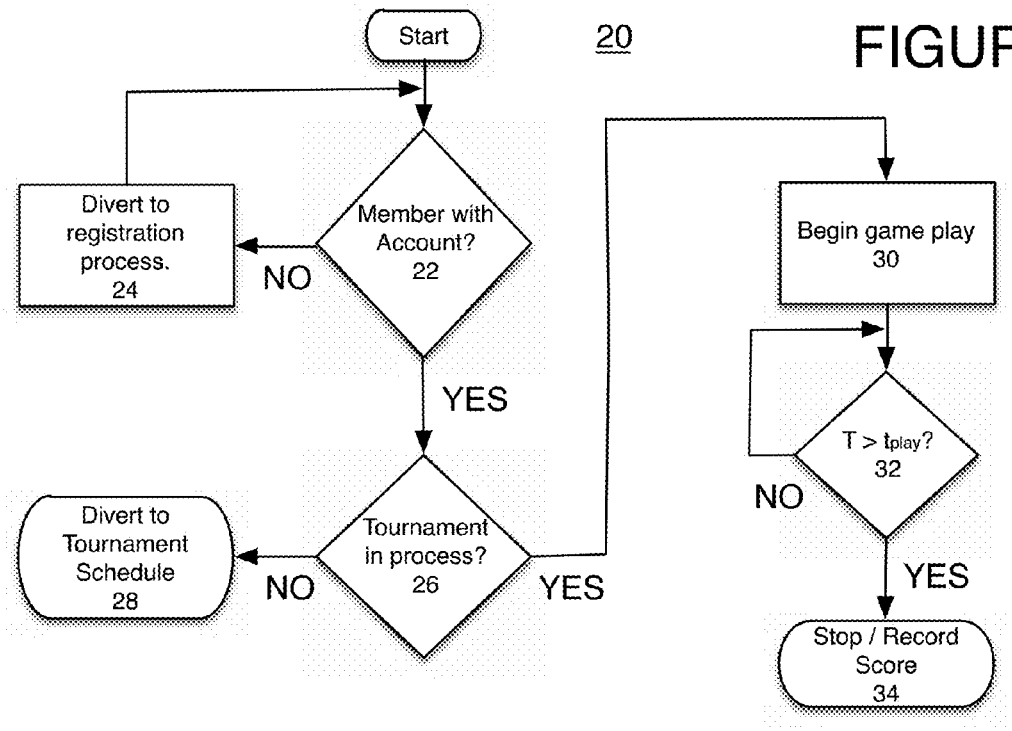
FIG. 2 shows an example of a process for "picking the board" executed by server when a player at a client connects to the server, in accordance with an embodiment of the invention.

FIG. 2 shows an example of a process 20 executed by server 10 when a player at a client 12 connects to the server. At 22, the server may execute a process to determine whether the player is a member that has an account with the tournament service. This may be done by running a log-in or similar script that requires the user to enter log-in credentials for the service. If the player is not a member of the tournament service, the player may be diverted to a registration process 24, which provides the player with an opportunity to become a member. This may involve the player providing certain personal information, including, for example, information sufficient to establish that the player is of legal age to play in tournaments of the kind offered through the service. Although shown as an in-line process, obtaining membership in the service may be a separate process that requires some time to complete, as for example where verification of the member's age, etc. is required through secondary sources.

If the server determines that the player is a member of the service 22, the server determines whether there is an existing tournament in progress 26. This is essentially a check of whether the time for a tournament selected by the player is within a period $t_{start}$ and $t_{end}$. If not, the player may be diverted to a schedule 28 that provides information regarding upcoming tournament dates/times. If, however, the player's desired tournament has commenced, the player is provided an opportunity to begin game play 30.

The server then permits the player to play the game 32. Upon completion, game play is concluded and after results of the week's sporting events are available, the player's score is recorded 34. Upon completion of the tournament, the server determines the winner (e.g., the player with the highest score) and the winning player is so notified (not shown). Optionally, player results may be posted in a player's account or other venue where the player can review his/her own scores and, optionally, scores of other players.

Preferably, the server 10 logs information concerning a number of aspects of the tournament. For example, logs that indicate which players participated in a tournament, when, how often and for how long at a time are kept. So too are logs of all player scores, winnings, etc. Logs that record technical faults, communication problems, etc. that may become the subject of a complaint or may be grounds for providing repeat play opportunities are also kept.

FIG. 2 shows game play as being continuous during the time $t_{start}<T<t_{play}$, but this need not necessarily be the case. In some instances, players may be permitted to pause their play and to return at a later time within the date/time boundaries of the tournament. In such instances, the server would save the game state for the player so that the game can be again instantiated from the point at which it was paused upon the player's return.

Figure 3:
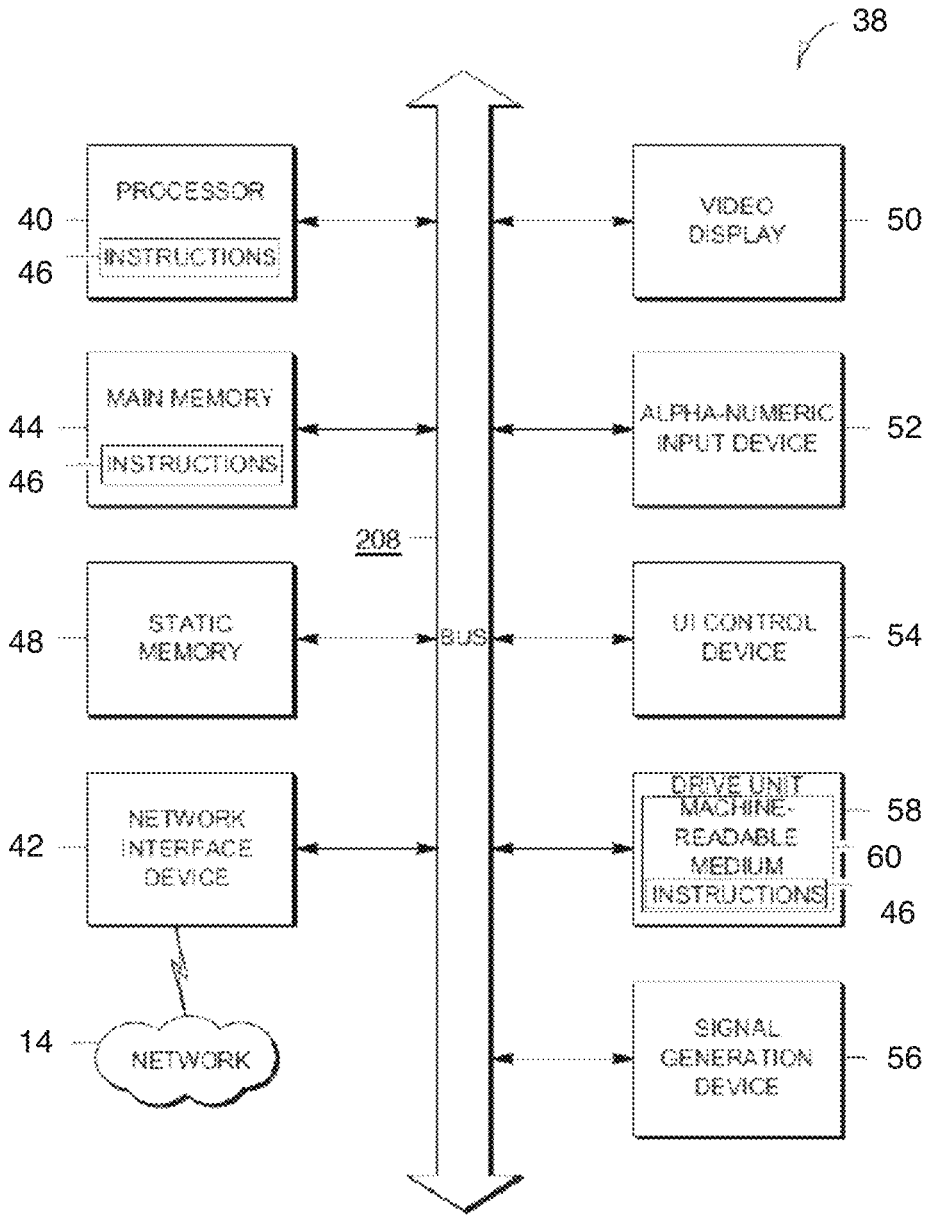
FIG. 3 illustrates an example of a computer apparatus suitable for executing processes for "picking the board" in accordance with an embodiment of the invention.

As evident from the foregoing discussion, one or more of the methods or processes described herein may be executable on various computer-based devices (e.g., clients 12 and/or server 10). Such devices, an example (38) of which is illustrated in FIG. 3, may include any electronic device capable of performing the actions described above (using suitable programming) and, where applicable, processing the information for display so as to properly convey the information. Examples of such devices include desktop computers, laptop computers, cellphones, smart phones, tablet computers, computer game consoles, portable computer gaming consoles, media players, portable media players, other mobile devices, and the like.

In such devices, a processor 40 may control the overall functions of the electronic device such as running applications and controlling peripherals. Such a processor may be any type of processor and may communicate with network interface device 42 to transmit and receive signals (e.g., cellular, Bluetooth, Wi-Fi, WiLAN, or other communication signals) over a network 14. The processor may use main memory 44 and/or a cache to store operating instructions 46 and to help in the execution of the operating instructions (e.g., such as the temporary storage of calculations and the like). The processor may also use non-transitory storage 48 and/or long-term storage 58 (such as a flash drive, hard disk or other unit comprising a tangible machine readable medium 60) to store and read instructions, files, and other data that requires long term, non-volatile storage.

The processor may communicate and control other peripherals, such as a display 50 with associated touch screen sensor, causing images to be displayed on the display and receiving input from the touch screen sensor when a user presses on the touch-screen display. In some examples, a touch screen sensor may be a multi-touch sensor capable of distinguishing and processing gestures.

The processor may receive input from a physical keyboard 52 and/or mouse/touch pad 54. In other examples, the device may utilize a touch screen keyboard using the display and touch screen sensor. The processor may produce audio output and other alerts that are played on a speaker or other signal generation device 56. A microphone (not shown) may be used as an input device for the processor to receive commands using voice-processing software. In the case of a client 12, an accelerometer may provide input on the motion of the device to the processor. An accelerometer may be used in motion sensitive applications, or, for example, in connection with scrolling content using tilting gestures, etc.

A Bluetooth module may be used to communicate with Bluetooth-enabled external devices. A USB port may enable external connections to other devices (e.g., mice or other cursor control devices) supporting the USB standard and charging capabilities. An external storage module may include any form of removable physical storage media such as a flash drive, micro SD card, SD card, Memory Stick, and the like.

Figure 4:
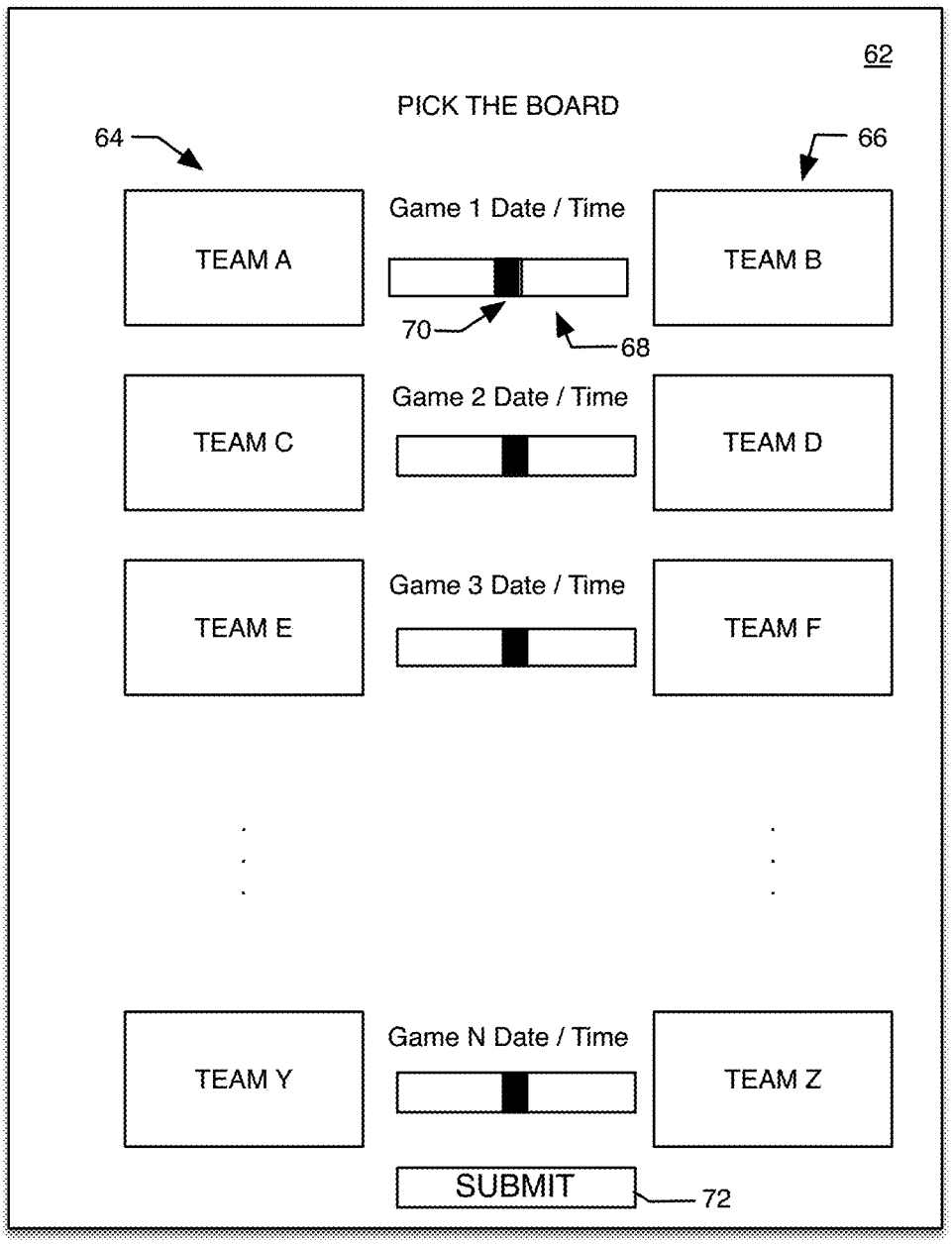
FIG. 4 illustrates an example of a game piece for "picking the board" in accordance with an embodiment of the invention.

Referring now to FIG. 4, an example of a game piece 62 is illustrated. The game piece includes two columns 64, 66 of teams expected to compete in contests (games) during a specified period of time. For example, the game piece may include a week's work of NFL football games, where the teams expected to compete against one another during that week are arranged opposite to one another, one in each column. Other sporting events or contests can be arranged in similar fashion.

Disposed between the columns of teams (or other contest opponents) are sliders 68. The sliders include a toggle 70. By manipulating the toggle of each slider, the user indicates a selection—i.e., indicates the team (or other contest participant) that the user picks as the winner of the contest. After an entire game piece is completed, by the user having selected a winner of each game in the fashion described above, the user submits the game piece by selecting the submit button 72.

Figure 5:
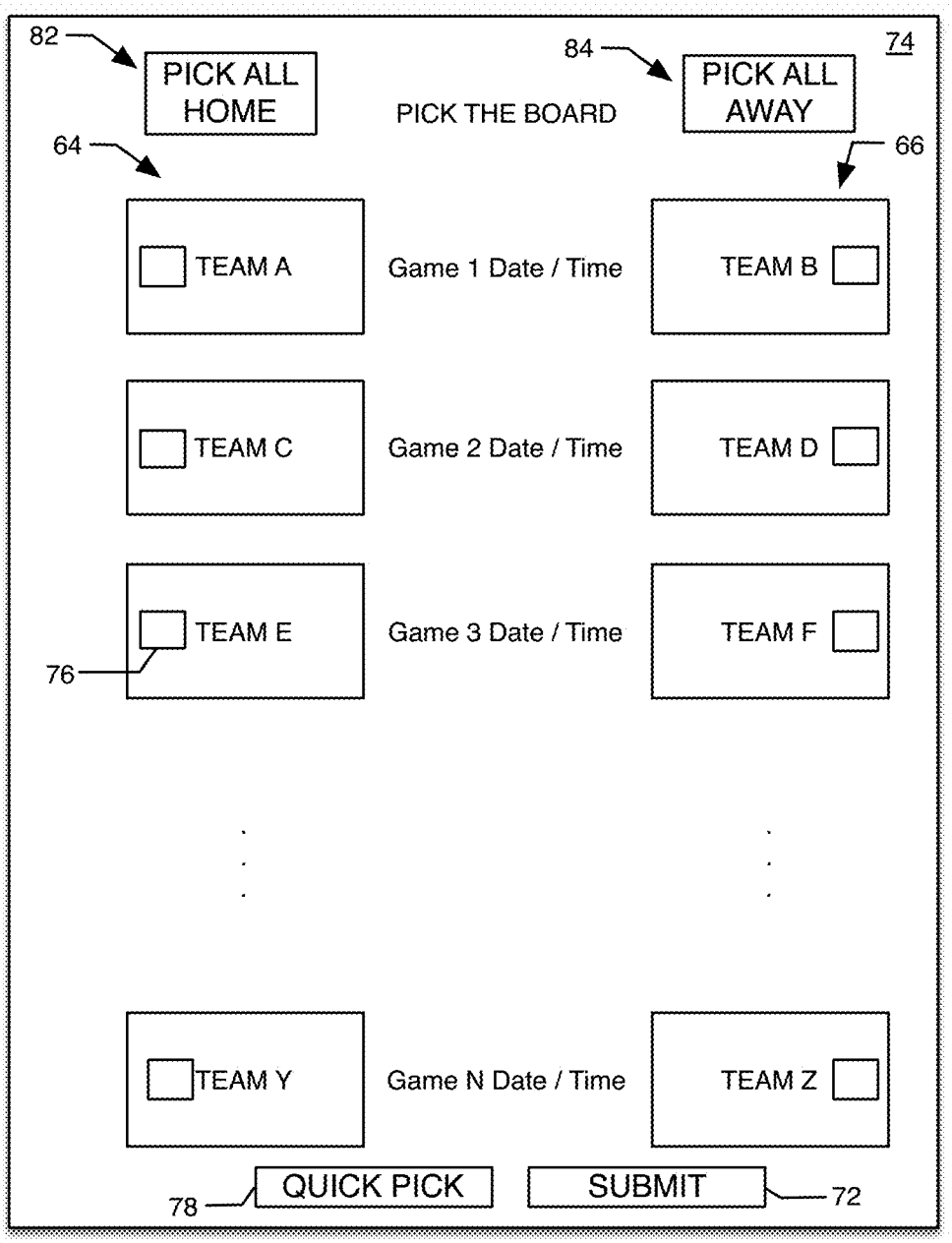
FIG. 5 illustrates an alternative example of a game piece for "picking the board" in accordance with an embodiment of the invention.

An alternative game piece 74 is shown in FIG. 5. In this example, the winner selections are indicated by the user selecting check boxes 76, rather than using sliders. In some instances, a game piece may provide both the check boxes and sliders and the user may use either option for making his/her picks. Also shown in the illustration is a "quick pick" button 78. Selecting the quick pick button will cause the system to make selections for all of the games on behalf of the user and submit those selections as the user's picks. In similar fashion, selecting a "pick all home" button 82 will cause the system to select all of the teams in column 64 as the winners of games on behalf of the user and submit those selections as the user's picks. Selecting a "pick all away" button 84 will cause the system to select all of the teams in column 66 as the winners of games on behalf of the user and submit those selections as the user's picks.

The game piece is a user interface that is presented by server 10 to a user via a display of a client 12. A valid game piece requires that picks for all games represented on the game piece must be made. Upon submission of a game piece, the server 10 checks to determine whether the game piece is valid. If not, the server prompts the user to complete the game piece by making picks for all of the games represented thereon. If the game piece is valid, the server accepts the game piece and enters the user's picks in the sweepstakes contest. The server may also return a message to a user thanking the user for his/her submission and may, in addition, provide the user with a screen 86, shown in FIG. 6, that summarizes the user's picks. This screen may be updated periodically to show the actual winners of the contests represented thereon, as they are determined by playing of the contests.

Certain embodiments are described herein as including logic or a number of components, modules, or mechanisms. Modules or components may constitute software modules (e.g., code embodied on a non-transitory machine-readable medium) or hardware-implemented modules. A hardware-implemented module is a tangible unit capable of performing certain operations and may be configured or arranged in a certain manner. In example embodiments, one or more computer systems (e.g., a standalone, client or server computer system) or one or more processors may be configured by software (e.g., an application or application portion) as a hardware-implemented module that operates to perform certain operations as described herein.

In various embodiments, a hardware-implemented module may be implemented mechanically or electronically. For example, a hardware-implemented module may comprise dedicated circuitry or logic that is permanently configured (e.g., as a special-purpose processor, such as a field programmable gate array (FPGA) or an application-specific integrated circuit (ASIC)) to perform certain operations. A hardware-implemented module may also comprise programmable logic or circuitry (e.g., as encompassed within a general-purpose processor or other programmable processor) that is temporarily configured by software to perform certain operations. It will be appreciated that the decision to implement a hardware-implemented module mechanically, in dedicated and permanently configured circuitry, or in temporarily configured circuitry (e.g., configured by software) may be driven by cost and time considerations.

Accordingly, the term "hardware-implemented module" should be understood to encompass a tangible entity, be that an entity that is physically constructed, permanently configured (e.g., hardwired) or temporarily or transitorily configured (e.g., programmed) to operate in a certain manner and/or to perform certain operations described herein. Considering embodiments in which hardware-implemented modules are temporarily configured (e.g., programmed), each of the hardware-implemented modules need not be configured or instantiated at any one instance in time. For example, where the hardware-implemented modules comprise a general-purpose processor configured using software, the general-purpose processor may be configured as respective different hardware-implemented modules at different times. Software may accordingly configure a processor, for example, to constitute a particular hardware-implemented module at one instance of time and to constitute a different hardware-implemented module at a different instance of time.

Hardware-implemented modules may provide information to, and receive information from, other hardware-implemented modules. Accordingly, the described hardware-implemented modules may be regarded as being communicatively coupled. Where multiple of such hardware-implemented modules exist contemporaneously, communications may be achieved through signal transmission (e.g., over appropriate circuits and buses) that connects the hardware-implemented modules. In embodiments in which multiple hardware-implemented modules are configured or instantiated at different times, communications between such hardware-implemented modules may be achieved, for example, through the storage and retrieval of information in memory structures to which the multiple hardware-implemented modules have access. For example, one hardware-implemented module may perform an operation, and store the output of that operation in a memory device to which it is communicatively coupled. A further hardware-implemented module may then, at a later time, access the memory device to retrieve and process the stored output. Hardware-implemented modules may also initiate communications with input or output devices, and may operate on a resource (e.g., a collection of information).

The various operations of example methods described herein may be performed, at least partially, by one or more processors that are temporarily configured (e.g., by software) or permanently configured to perform the relevant operations. Whether temporarily or permanently configured, such processors may constitute processor-implemented modules that operate to perform one or more operations or functions. The modules referred to herein may, in some example embodiments, comprise processor-implemented modules.

Similarly, the methods described herein may be at least partially processor-implemented. For example, at least some of the operations of a method may be performed by one or more processors or processor-implemented modules. The performance of certain of the operations may be distributed among the one or more processors, not only residing within a single machine, but also deployed across a number of machines. In some example embodiments, the processor or processors may be located in a single location, while in other embodiments the processors may be distributed across a number of locations.

The one or more processors may also operate to support performance of the relevant operations in a "cloud computing" environment or as a "software-as-a-service" (SaaS) service. For example, at least some of the operations may be performed by a group of computers (as examples of machines including processors), with these operations being accessible via a network (e.g., the Internet) and via one or more appropriate interfaces (e.g., Application Program Interfaces (APIs).)

Example embodiments may be implemented in digital electronic circuitry, or in computer hardware, firmware, software, or in combinations of them. Example embodiments may be implemented using a computer program product, e.g., a computer program tangibly embodied in an information carrier, e.g., in a machine-readable medium for execution by, or to control the operation of, data processing apparatus, e.g., a programmable processor, a computer, or multiple computers.

A computer program may be written in any form of programming language, including compiled or interpreted languages, and it may be deployed in any form, including as a stand-alone program or as a module, subroutine, or other unit suitable for use in a computing environment. A computer program may be deployed to be executed on one computer or on multiple computers at one site or distributed across multiple sites and interconnected by a communication network.

In example embodiments, operations may be performed by one or more programmable processors executing a computer program to perform functions by operating on input data and generating output. Method operations may also be performed by, and apparatus of example embodiments may be implemented as, special purpose logic circuitry, e.g., a field programmable gate array (FPGA) or an application-specific integrated circuit (ASIC).

The foregoing description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, or process that includes elements in addition to those listed after such a term in a claim are still deemed to fall within the scope of that claim. Moreover, in the following claims, the terms "first," "second," and "third," and the like are used merely as labels, and are not intended to impose numerical requirements on their objects.

Method examples described herein can be machine or computer-implemented at least in part. Some examples can include a computer-readable medium or machine-readable medium encoded with instructions operable to configure an electronic device to perform methods as described in the above examples. An implementation of such methods can include code, such as microcode, assembly language code, a higher-level language code, or the like. Such code can include computer readable instructions for performing various methods. The code may form portions of computer program products. For example, the code can be stored on one or more non-transitory, or non-volatile tangible computer-readable media, and may be loaded into volatile media during execution or at other times (e.g., during a transfer between storage devices, etc.). Examples of these tangible computer-readable media can include, but are not limited to, hard disks, removable magnetic disks, removable optical disks (e.g., compact disks and digital video disks), magnetic cassettes, memory cards or sticks, read only memories (ROMs), flash memories or other solid state devices (SSDs) and the like.

What is claimed is:

1. A computer-readable storage device having stored thereon computer-executable instructions, which instructions, when executed by a processor, cause the processor to:

provide a user interface for a computer-based sweepstakes contest in which players compete for cash prizes by selecting, via a game piece displayed within the user interface, winners for a plurality of live sporting events occurring within a defined time period, wherein said players are not charged any entry fee for participating in the sweepstakes contest and players who win the sweepstakes contest receive cash prizes, wherein the game piece includes options for (1) a manual selection of the winners and (2) a quick pick option for a computer automated selection of the winners; and for at least one of the players, (i) receiving, via the user interface, an indication of a desire from the player to participate in a tournament of the sweepstakes contest;

(ii) determining whether the tournament selected by the player is in progress, wherein the tournament is in progress if a current time is between a first time, $t_{start}$, and a second time $t_{end}$ which collectively define an entry period for the tournament, and, if not, directing the player to a schedule that provides information concerning upcoming tournaments of the sweepstakes contest, otherwise, if so, providing, via the user interface, the game piece that facilitates the player's selection of winners or the quick pick option; and (iii) receiving a purportedly complete game piece comprising the player's selection of winners or the quick pick option, and, provided the purportedly complete game piece includes selections for all sporting events requiring a predicted winner on the game piece, entering the purportedly complete game piece as a completed game piece associated with the player in the sweepstakes contest, otherwise, prompting the player to provide further selections of winners for the game piece and repeating reception of an updated game piece as the purportedly complete game piece.

* * * * *